US005352144A

United States Patent [19]

Kuhn

[11] Patent Number: 5,352,144

[45] Date of Patent: Oct. 4, 1994

[54] WIND ACTIVATED TOY

[76] Inventor: Gerald F. Kuhn, P.O. Box 803, Sandia Park, N. Mex. 87047

[21] Appl. No.: 59,675

[22] Filed: May 12, 1993

[51] Int. Cl.[5] ..... A63H 33/40; A63H 29/16; A63H 27/08

[52] U.S. Cl. ..... 446/176; 446/433; 446/431; 244/153 R; 244/153 A; 482/66; 482/78

[58] Field of Search ..... 446/176, 239, 255, 433, 446/431, 61, 66, 67, 465, 217; 244/153 R, 153 A; 180/2.2; 440/95-97; 482/78, 66

[56] References Cited

U.S. PATENT DOCUMENTS

| | | | |
|---|---|---|---|
| D. 64,764 | 5/1924 | Schultz . | |
| 1,434,563 | 11/1922 | Robertson . | |
| 1,577,362 | 3/1926 | Reiterer . | |
| 3,374,763 | 3/1968 | Browning . | |
| 3,747,263 | 11/1973 | Grossberg . | |
| 3,786,583 | 1/1974 | Revor . | |
| 3,934,291 | 1/1976 | Hagen | 482/78 X |
| 3,967,798 | 7/1976 | Christoffer | 244/153 R |
| 4,452,007 | 6/1984 | Martin | 446/255 X |
| 4,624,648 | 11/1986 | Waters | 446/176 |
| 4,830,313 | 5/1989 | Cheng | 244/153 R |
| 4,884,328 | 12/1989 | Neighbors | 446/217 X |
| 4,895,384 | 1/1990 | Kaiser | 482/78 X |

FOREIGN PATENT DOCUMENTS

| | | | |
|---|---|---|---|
| 525862 | 9/1921 | France | 440/97 |
| 2130902 | 6/1984 | United Kingdom . | |

*Primary Examiner*—Danton D. DeMille
*Attorney, Agent, or Firm*—Pollock, Vande Sande & Priddy

[57] ABSTRACT

A toy activated air movement including a loop of a self-supporting flexible sheet-like material. The loop has an interior surface and an exterior surface and a major axis perpendicular to the direction of travel. The loop is formed of a material which at least partially deforms under its own weight and has sufficient rigidity such that a portion of the interior surface of the loop will not contact an opposite portion of the interior surface of the loop when the toy is placed upon a supporting surface. The toy travels along the supporting surface in response to air movement. A plurality of flaps extend outwardly from the exterior surface of the loop generally in a direction parallel to the major axis of the loop. The flaps are angled away from the exterior surface of the loop, whereby air impacting upon the flaps will cause the toy to roll about the major axis along the supporting surface.

21 Claims, 3 Drawing Sheets

WIND ACTIVATED TOY

FIELD OF THE INVENTION

The invention relates to a wind driven toy and in particular to a toy designed to roll along a surface in response to air movement.

BACKGROUND OF THE INVENTION

Wind driven toys are well known and quite popular. For instance, familiar wind driven toys include kites, toy sailboats, pinwheels, and whirligigs, among others. In fact, toys for use in the outdoors are very popular and are probably increasing in popularity with the recent increase of people enjoying outdoor activity. Quite often, even the slightest breeze will bring out a number of kite fliers flying everything from the most simple kite to very elaborate stunt kites. Additionally, pinwheels, whirligigs, and other such wind driven toys can be amusing to watch on breezy days.

Although these wind actuated toys are well known and widely used, they all suffer from a serious drawback. All known wind driven toys are static, in that the user of a kite or toy sail boat, for example, uses these devices while remaining substantially stationary. Such devices are incompatible with the desire to enjoy a breezy day while exercising. This drawback of these toys is especially noticeable given the emphasis on activity and exercise prevalent in society today. It is quite well known that a sedentary lifestyle and maintaining a healthy body are mutually exclusive ideas. Therefore, it would be advantageous to have a toy which would allow people to have fun on a windy day as kites and other such devices allow, while also providing the opportunity for enjoying a good aerobic workout. Such a toy could also encourage people to abandon indoor, sedentary habits and activities, such as video games.

A drawback of many other popular toys is that they require a power source of some sort, whether batteries or otherwise. Advantageously, with the increased emphasis on environmental friendliness in all aspects of peoples' lives, a decrease in power consumption and/or disposable battery consumption would be enjoyed by all. Therefore, it would be desirable to have a toy not requiring an outside, polluting power source.

SUMMARY OF THE INVENTION

The present invention provides a toy capable of being activated by air movement. The toy includes a loop having an interior surface and an exterior surface. The loop is formed of a material having sufficient rigidity so as to prevent any portion of the interior surface from coming into contact with any other portion of the interior surface of the loop while the toy is in motion. A plurality of flaps extend from the exterior surface of the loop. The flaps are angled away from the outer surface of the loop. The present invention meets the above-described goals of providing a toy designed to encourage outdoor, healthy, nonpolluting activity.

DETAILED DESCRIPTION OF THE PREFERRED EMBODIMENTS

The present invention provides a toy which is designed to move along a surface in response to air movement. Preferably, the toy is designed to be placed upon the ground, the surface of a body of water, or other surface and move in response to air movement acting upon it. The user of the toy can then run alongside or chase the toy. By providing a toy which operates in this manner, the present invention allows the user to exercise while enjoying a wind activated toy. Other known wind activated toys, such as kites, toy sailboats, pinwheels, and whirligigs, fail to provide this opportunity for exercise as well as enjoyment of a wind activated toy.

Figure 1:
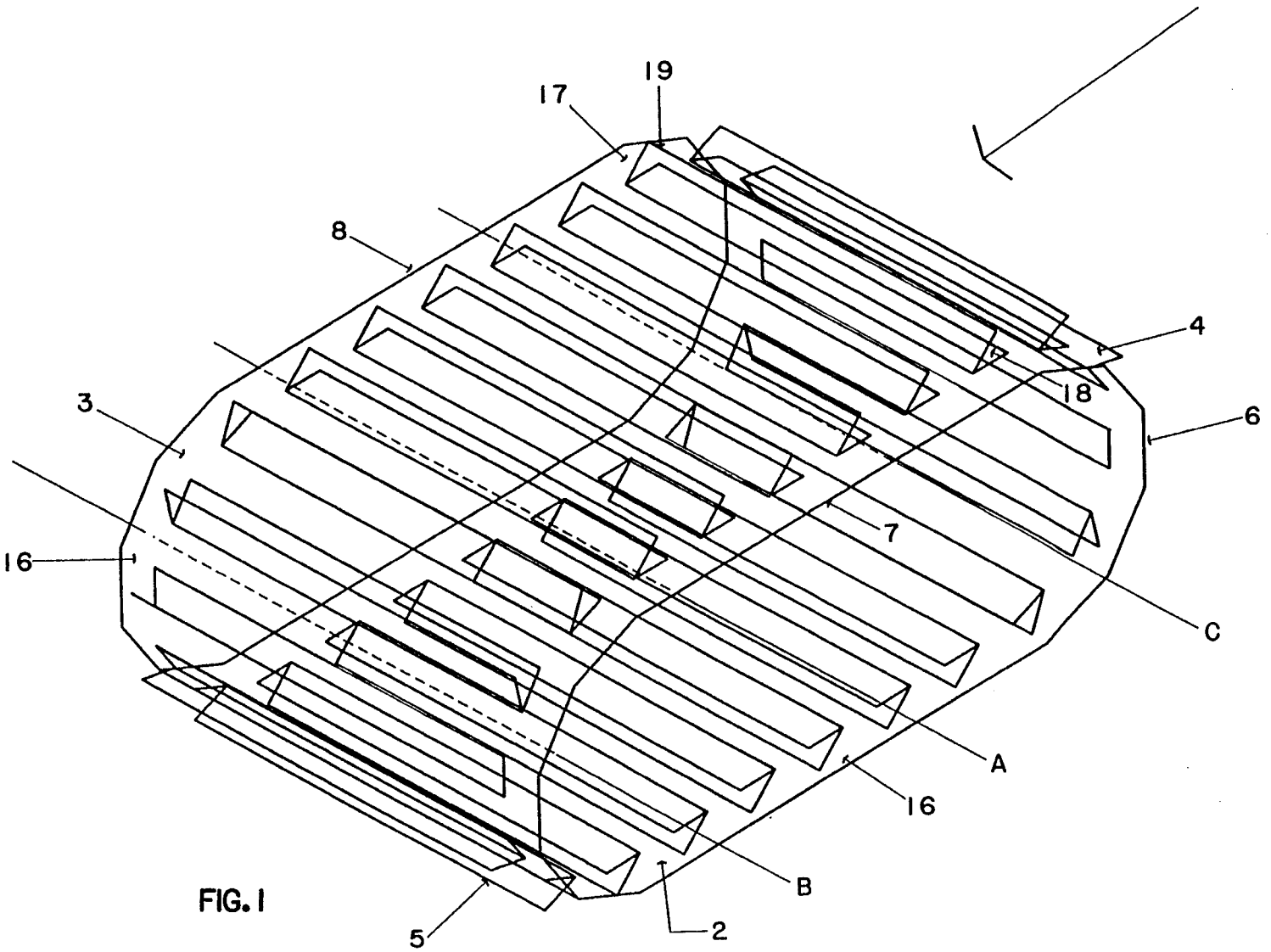
FIG. 1 is a perspective view of one embodiment of the present invention.

As seen in the embodiment shown in FIG. 1, the present invention preferably includes a loop 1. The loop preferably has an interior surface 2 and an exterior surface 3. A plurality of flaps 4 preferably extend from the surface of the loop so as to provide a cross sectional area designed to be acted upon by air movement. The toy is propelled in the direction of the air movement.

As seen in FIG. 1, the loop of the present invention may be a continuous piece of material which may be substantially flat along its width. When constructed in such a manner, the toy takes on a shape, as shown in FIG. 1, of generally an elongated ellipse when in use. The embodiment shown in FIG. 1 is depicted as it would be oriented when placed upon a surface for use. This embodiment preferably includes a major axis A which lies parallel to the interior and exterior surfaces of the loop and passes through the center of gravity of the loop, parallel to the direction of travel of the loop. The embodiment shown in FIGS. 1–4 also preferably includes a front axis b located toward the front of the loop as it moves in response to the wind, and a rear axis c, located toward the rear of the loop, as it moves in response to the wind.

Preferably, the material from which the loop is formed is sufficiently rigid so as to prevent the loop from completely collapsing when placed upon the ground. In other words, in preferred embodiments, the material should be sufficiently rigid such that the toy is capable of traveling along a surface in response to air movement. Preferably, the material is sufficiently rigid so as to prevent the interior surface midway between the ends 5 and 6 of the loop from touching the other portions of the interior of the loop on substantially the opposite side of the loop when the loop is placed upon the ground for use. Examples of such materials which the loop could be made of include plastics, such as MYLAR, polyethylene, and semi-rigid plastics, paper, including construction or bond paper, rice paper, and waxed paper and other coated papers, among others. Any material having sufficient rigidity to prevent the interior surfaces from touching may be used for the preferred embodiments of the present invention. In keeping with its environmental friendliness, the present invention could be made of recycled paper or plastic.

As seen in the embodiment shown in FIG. 1, the surfaces 2 and 3 of the loop may be substantially parallel to the major axis A of the loop. The major axis A may be the axis perpendicular to the generally rounded cross section of the loop. However, the surfaces of the loop may be configured in other ways.

For instance, the outer edges 7 and 8 of the loop may be drawn further away from the major axis of the loop so that the center portion 9 of the loop is closer to the major axis of the loop than the edge portions, such as the shape formed by two intersecting frustrums. The outside surface of the loop could have any other cross section allowing the loop to roll along the ground. For example, the surface could be four intersecting frustrums, or could have an undulating wave form. Additionally, the present invention is not limited to the elongated elliptical cross section as in the embodiment shown in FIG. 1. For instance, the toy could have a circular cross section, or any other cross section which, along with the rigidity of the loop, allows the toy to roll along a surface. Such an alternative embodiment is an example in which opposite points on the interior surface of the loop need not necessarily be prevented from touching.

Figure 4:
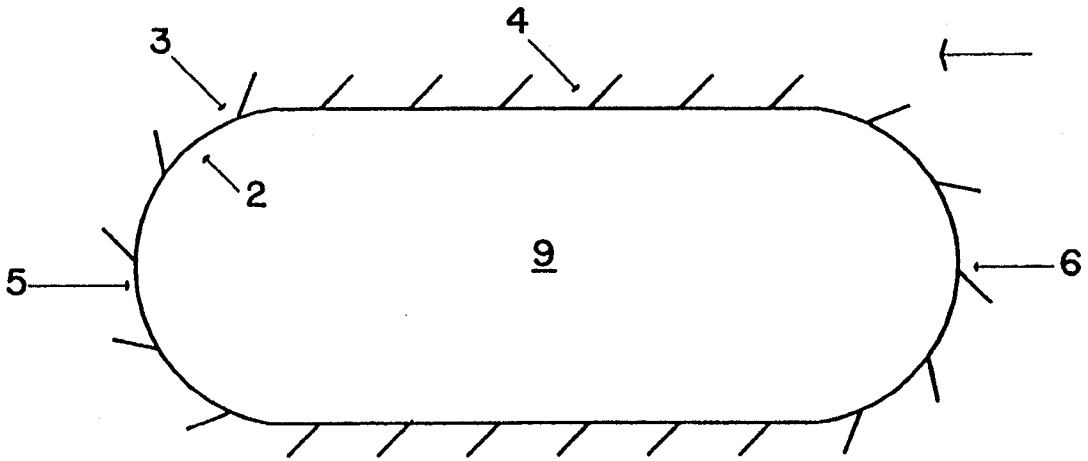
FIG. 4 is a side view of the embodiment of the present invention shown in FIG. 1.
Figure 5:
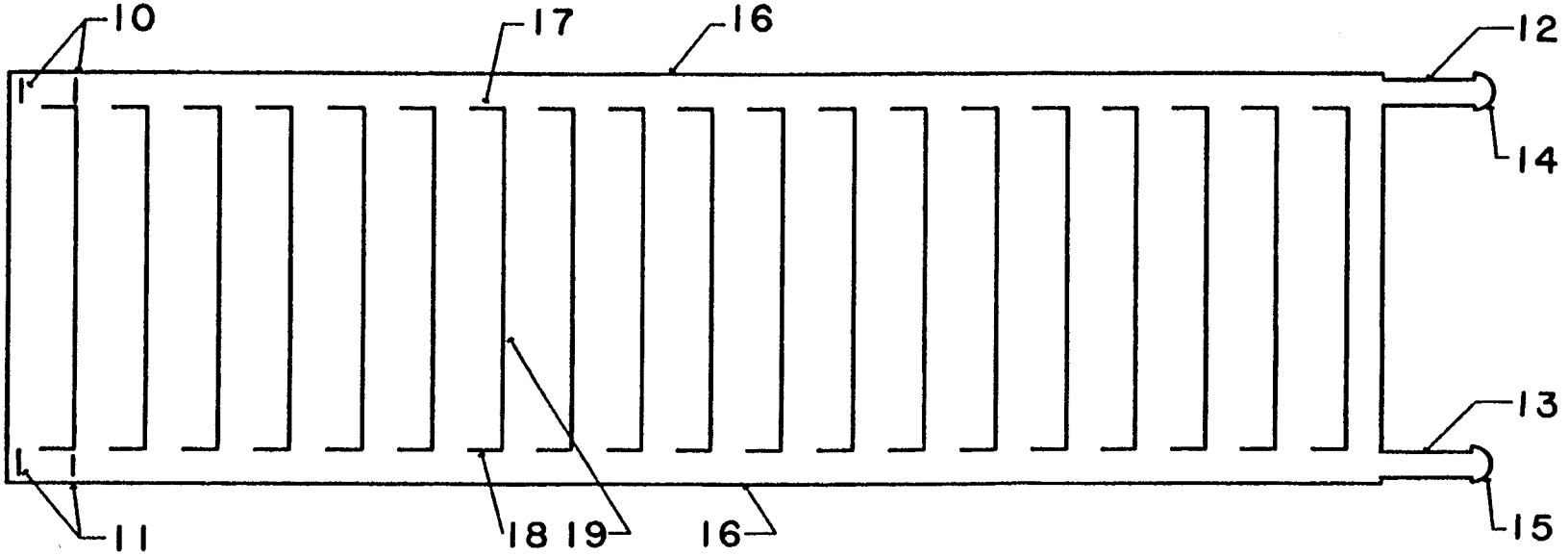
FIG. 5 represents an overhead view of another embodiment of the present invention.

The loop 1 may be a single continuous sheet of material, without any seams. Alternatively, the loop may be formed from a single piece of material having one or more seams and including means to join the loop at the seams. For instance, as seen in FIG. 5, the loop of the embodiment shown in FIGS. 1–4 may include a single seam formed parallel to the major axis of the loop. The ends of the loop formed by the seam(s) may be permanently or temporarily joined together.

The embodiment shown in FIG. 5 preferably includes two pairs of slots 10 and 11 formed on opposite sides of the loop, adjacent to the seam at one end of the loop. Adjacent the seam, the other end of the loop preferably includes two interlocking tabs 12 and 13 placed on opposite sides of the loop. The tabs are preferably shaped so as to slip into the slots 10 and 11 after being compressed and then expand after passing into the slots so as to prevent their removal from the slots.

In the embodiment shown in FIG. 5, the tabs have a circular shape, connected to the rest of the loop by a neck portion which is thinner than the diameter of the circular section. The circular portion of the tab included in this embodiment will be folded up for insertion into one or both of the slots adjacent the other seam of the loop. The circular portion preferably will return to its circular shape after insertion into the slot(s), thereby preventing the loop from coming apart.

Alternatively, the two ends of the loop may be joined with an adhesive, VELCRO, tape, a zipper, a zip-lock closure, a snap closure or any other suitable means for securing such seams. The closure may be permanent or temporary. Whether the loop is made from a continuous piece, the present invention may be rolled up for shipping, sale, and storing. In this way, the present invention may be reduced to a very compact body, making storage, shipping, and display for sale very easy. In fact, the toy may act as its own package when rolled up. When rolling up the present invention, the flaps formed in the loop preferably are folded flat so as to not extend from the surface of the loop.

The present invention may be formed in any size and therefore is not limited to any size or the relative dimensions of various parts or the size of the parts relative to the whole toy. In preferred embodiments, the loop may also be formed of any thickness of material provided that while in use, the interior surfaces do not touch. Preferably, the material used to form the toy and thickness of the material used will allow the exterior surface of the toy to change in response to moving over changing surfaces. The material thickness preferably is proportional to the overall size and shape of the loop.

The overall length of the present invention, regardless of the shape, is a function of the rigidity of the material utilized to form the toy. The shape of preferred embodiments of the toy will only be maintained if the proper balance is maintained between the rigidity of the material and the overall dimensions to prevent the toy from collapsing. The relative size as compared to the rigidity of the material can also control the angle of the flaps, as the material flexes under its own weight, and allow the toy to flex in response to, conform to, and traverse over varied terrain. For instance, a loop of the proper length, as compared to the other dimensions of the loop and the material making up the loop will allow the loop to flatten out about the rear axis c and swell about the front axis b.

As with the length, the width of the loop controls the stability of the toy to travel in a longitudinal direction. The width can control the tendency of the toy to tumble. As with the length of the loop, the width of the loop is also a function of the rigidity of the material used to make the loop.

The width is also a function of the other dimensions of the loop. For instance, the width of the loop is also a function of the distance between the sides of the flaps and the edge of the loop, the distance between the flaps, and the corresponding weight of the material making up the loop. Preferably the width is greater than the vertical distance between the interior surfaces of the loop when it is placed on the ground so as to provide the toy with the optimum stability. However, the loop may be formed in any width desired. The width in relation to the other dimensions of the loop can also effect the ability of the loop to react to variations in wind speed and terrain.

The loop may be formed of any size. Larger loops may be desired in a stronger wind, to survive the wind. Smaller loops may be desired in lighter winds to ensure that the loop is not too heavy to roll, but must provide sufficient surface area to capture the wind. If the toy is formed according to the embodiment shown in FIGS. 1–4, given that X represents the height of the flaps, the loop preferably is about 12X wide and about 16X long. These relative dimensions can vary depending upon the material used to form the loop and with the shape of the loop, among other factors.

To provide the present invention with the ability to move in response to air movement, a plurality of flaps 4 are extended from the outer surface 3 of the loop, providing a surface upon which the moving air can act. The flaps may be formed from the material of the loop. As seen in the embodiment shown in FIGS. 1–4, the flaps may be formed substantially parallel to the major axis A of the loop. However, the flaps 4 conform to the orientation of the surface of the loops and, therefore, the flaps may not be parallel to the central major axis A of the loop. For instance, if the loop were formed as two intersecting frustrums as described above, the flaps would not be parallel to the major axis of the loop.

Preferably, as seen in the embodiment shown in FIGS. 1–4, the flaps may be formed from the material making up the loop. In such an embodiment, the flaps may be formed by cutting along three sides of an elongated rectangle parallel to the major axis of the loop. Using this construction, two short-cuts may be formed substantially parallel and adjacent to the edges of the loop. The length of these cuts is considered to be the length of the flaps. If the flaps are formed in this manner, these two cuts form the two side edges 17 and 18 of the flaps.

In this embodiment, the material between the edge of the flaps and the edge of the loop forms a ribbon 16 about each of the edges of the loop. If this ribbon 16 is too wide, the shape of the loop 1 may be adversely effected by the tendency of the loop to collapse. Alternatively, if the ribbon 16 is too narrow, the stability of the loop 1 may be adversely effected.

A third cut may be made connecting the first two shorter cuts. The third cut may be substantially parallel to the major axis of the loop. The length of this cut is considered to be the width of the flaps. If the flaps are formed in this manner, this cut forms the leading edge of the flaps 19. Rather than being parallel to the edges or major axis of the loop, the cuts may be made at angles. Also, the cuts do not need to be straight. For example, the cuts could be made in an undulating manner.

The cuts forming the flaps preferably are made completely through the loop from the exterior surface to the interior surface. The flaps may then be folded along a substantially straight line connecting the ends of the two shorter parallel cuts. The flap may be folded away from the exterior surface of the toy preferably at an acute angle to the exterior surface. The angle of the flaps preferably is adjusted according to the wind conditions and according to the size of the toy, among other things. The greater the wind velocity, the more acute the flap angle can be. A lower flap angle produces less resistance on the running surface and increased speed. Preferably, the flaps are at about a forty-five degree angle to the surface of the loop.

In an alternative embodiment, the flaps may be cut in only a surface layer, with the openings formed form the extension of the flaps and not extending all the way through from the exterior surface to the interior surface of the loop. Alternatively, the flaps may be formed separately from the loop and glued or otherwise attached to the surface of the loop. Such flaps may be permanently or temporarily secured to the surface of the loop using adhesive, tape, VELCRO, or any other suitable means for securing. Flaps formed in an alternative manner may also be formed in any shape or size.

The actual size of the flaps can vary. Also, any number of flaps may be formed in the loop, and these flaps may be any distance apart. Further, the distance between flaps does not need to be equal. Nor does the angle between the flap and the exterior surface of the loop need to be the same. Additionally, each flap does not need to be the same size or shape.

In fact, the flaps may be broken down to include a number of flaplets. An embodiment of the present invention including such flaplets could include a number of the flaplets formed where each flap is formed in the embodiment shown in FIGS. 1–4. In such an embodiment, the flaplets in each line could be in the same location. On the other hand, the flaplets could be staggered so that no flaplet would be directly adjacent a flaplet in the adjacent line. Alternatively, the flaplets could be arranged in a pattern over the exterior surface of the loop, in or out of the alignment where the flaps are formed in the embodiment shown in FIGS. 1–4. The flaplets could be arranged randomly over the exterior surface of the loop.

All of the above-discussed parameters, including all of the dimensions of the flaps may vary. However, the size of the surface area of the flaps facing the wind and the angle at which the flaps extend away from the exterior surface of the loop must both be sufficient to allow the toy to function as designed. The flaps must not be angled at too great an angle, or too much air will enter the interior of the loop through the flaps. This can cause folding or compression of the loop. Additionally, the flaps interacting with the surface on which the toy moves must not collapse under the weight of the toy. Further, the flaps and the material which they are made of must be able to withstand the force of the wind without bending backwards, thereby not allowing the toy to capture the wind energy.

With a loop according to the embodiment shown in FIGS. 1–4, if the size of the edges of the flaps is represented by X, the distance between the edge of the flaps and the edge of the loop preferably is about 1.33X. In this embodiment, a point on one flap preferably is about 1.66X away from the corresponding point on the adjacent flaps. Additionally, the flaps preferably are about 9.33X long. The loops can be included in the same relative dimensions regardless of the method used for forming them. These dimensions can vary depending upon the shape of the loop and the wind speed in which the toy will be used, among other things.

Regardless of how the flaps are formed or their relative dimensions, the flaps can help to stabilize the toy. In particular, if the flaps are formed from the material of the loop, the fold in the material created when the flaps are pulled away from the surface of the loop can help to stabilize the loop. If the flaps are formed in another manner, including the fold, the fold will held to stabilize and strengthen the surface of the loop.

The present invention may include means to allow the toy to float. For instance, foam or other material less dense than water may be included in the structure of the present invention. With the addition of this material, the toy can roll across the water.

The toy may also include reinforcing material to allow the toy to operate at great speeds. Additionally, the loop of the present invention may be provided with weights at various points. Such weights can produce uneven rolling in the loop, giving the toy the appearance of jumping about as it rolls, producing a comedic effect.

Figure 3:
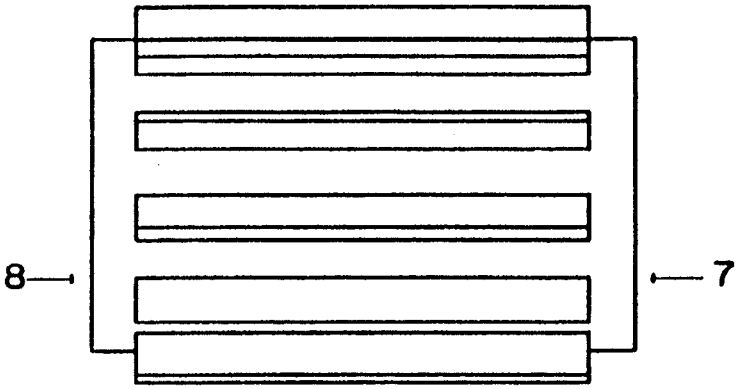
FIG. 3 is a front view of the embodiment of the present invention shown in FIG. 1.
Figure 2:
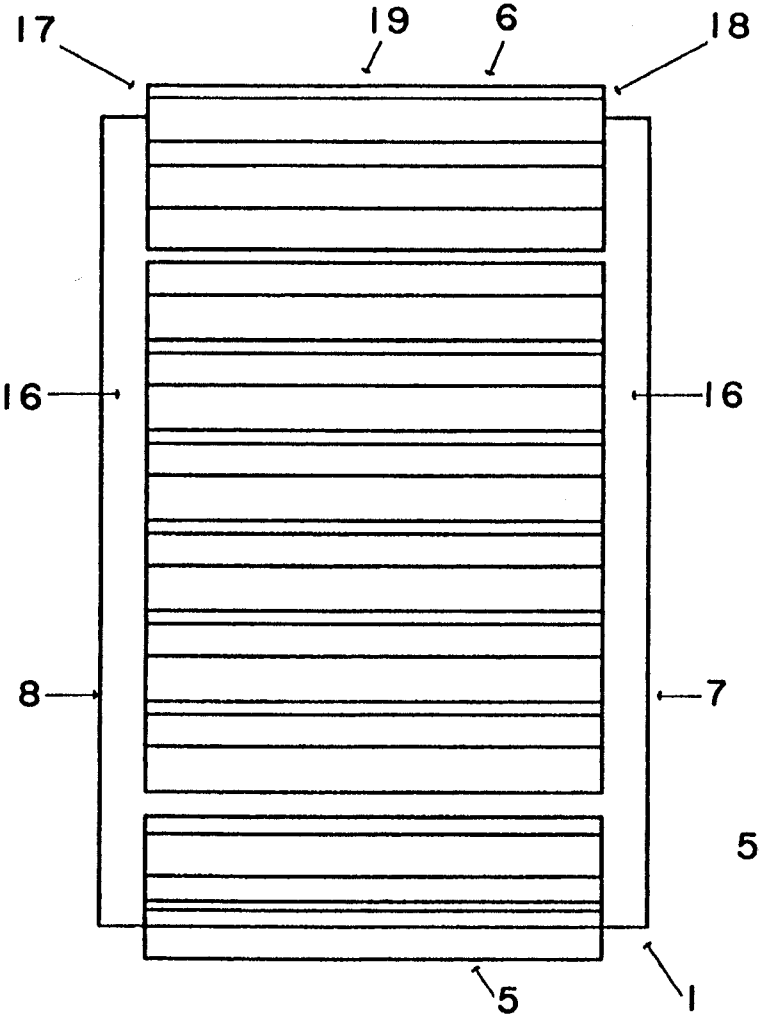
FIG. 2 is an overhead view of the embodiment of the present invention shown in FIG. 1.

FIG. 2 shows an overhead view of the embodiment of the present invention shown in FIG. 1. FIG. 3 shows a front view of the embodiment of the present invention shown in FIG. 1 and FIG. 4 shows a cross sectional view of the embodiment of the present invention shown in FIG. 1.

To use the present invention, it is placed with the exterior surface on the ground or other surface, with the flaps facing into the direction of the wind. The direction of the wind in FIG. 1 is shown by the large arrow in the upper right hand corner of the Figure. Alternatively, as shown in FIG. 4, the wind comes from the right. As the wind impacts upon the flaps, it applies force to the flaps, causing the loop to spin much as the tread on tank. The person using the toy can then run alongside or chase the toy.

The present invention provides a simple design for a toy which is inexpensive and easy to manufacture, regardless of the design and/or method which is used to form the present invention, the present invention is simple to construct and preferably does not result in a creation of any waste during formation of the loop or the flaps.

I claim:

1. A toy activated by air movement, comprising:

a loop of a self-supporting flexible sheet-like material, said loop having an interior surface and an exterior surface and a major axis perpendicular to the direction of travel, said loop being formed of a material which at least partially deforms under its own weight and having sufficient rigidity such that a portion of the interior surface of the loop will not contact an opposite portion of the interior surface of the loop when the toy is placed upon a supporting surface, said toy traveling along said supporting surface in response to air movement; and a plurality of flaps extending outwardly from said exterior surface of said loop generally in a direction parallel to the major axis of said loop, said flaps being angled away from the exterior surface of said loop, whereby air impacting upon said flaps will cause said top to roll about said major axis along said supporting surface.

2. The toy according to claim 1, wherein said flaps are formed at equally spaced intervals about said loop substantially parallel to a major axis of said loop.

3. The toy according to claim 2, wherein the distance between adjacent flaps on said loops is 1.66 times the length of each of said flaps, the width of said flaps is 9.33 times the length of said flaps, the edge of said flaps is 1.33 times the length of said flaps away from the edge of said loop.

4. The toy according to claim 1, wherein each of said flaps is angled outward at substantially the same angle away from said exterior surface of said loop.

5. The toy according to claim 4, wherein said angle is an acute angle.

6. The toy according to claim 4, wherein said angle is 45°.

7. The toy according to claim 1, wherein said toy is formed of a continuous substantially flat surface, said surface being substantially parallel to a major axis of said loop.

8. The toy according to claim 1, wherein the width of said loop is greater than the height of said loop while said toy is in use.

9. The toy according to claim 8, wherein when toy is in use, the height of said loop is six times the length of said flaps, the width of said loop is twelve times the length of said flaps, and the length of said loop is sixteen times the length of said flaps.

10. The toy according to claim 1, wherein said loop includes at least one seam formed in said loop, said at least one seam creating at least two ends in said loop, said loop including means for joining said at least two ends together to form said loop.

11. The toy according to claim 10, wherein said loop includes one seam and two ends and said means for joining said ends comprises:

at least one slot formed adjacent a first of said ends and at least one tab formed adjacent a second of said ends, said tab interlocking with said slot so as to secure said ends together.

12. The toy according to claim 10, wherein said loop includes one seam and two ends and said means for joining said ends is selected from the group consisting of VELCRO, adhesive, tape, a zipper, a zip-lock, at least one snap, and soldering.

13. The toy according to claim 1, wherein said flaps are substantially rectangular, wherein said rectangle is substantially longer in a direction parallel to said major axis of said loop than in a direction perpendicular to said major axis of said loop, such that said flaps are substantially as wide as said loop and said flaps are centrally located on said loop.

14. The toy according to claim 1, wherein said flaps have substantially straight sides.

15. The toy according to claim 1, wherein said flaps are formed in said loop and create openings from said exterior surface to said interior surface.

16. The toy according to claim 1, wherein said flaps are attached to said exterior surface of said loop.

17. The toy according to claim 1, wherein said toy is made of a material having sufficient rigidity so as to prevent any portion of the interior surface from coming into contact with any other portion of the interior surface of said loop while said toy is in use.

18. The toy according to claim 1, wherein said flaps comprise a plurality of flaplets formed over the exterior surface of said loop.

19. The toy according to claim 18, wherein said flaplets are arranged in parallel lines.

20. The toy according to claim 1, wherein said loop has a flexible shape.

21. The toy according to claim 1, wherein said toy is at least partially supported by at least one of the group consisting of said loop and said flaps such that said major axis is substantially parallel to said supporting surface when said toy is placed upon said supporting surface.

* * * * *